US008424722B2

(12) United States Patent
Koch et al.

(10) Patent No.: US 8,424,722 B2
(45) Date of Patent: Apr. 23, 2013

(54) SELF CONTAINED LUBRICANT DISPENSER

(75) Inventors: D. Christian Koch, Maple Grove, MN (US); Blade R. Wilson, Maple Grove, MN (US); Mark A. King, New Richmond, WI (US); Thomas C. Neese, Plymouth, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 1467 days.

(21) Appl. No.: 10/528,524

(22) PCT Filed: Sep. 19, 2003

(86) PCT No.: PCT/US03/29939

§ 371 (c)(1),
(2), (4) Date: Mar. 18, 2005

(87) PCT Pub. No.: WO2004/026705

PCT Pub. Date: Apr. 1, 2004

(65) Prior Publication Data

US 2006/0016832 A1 Jan. 26, 2006

Related U.S. Application Data

(60) Provisional application No. 60/412,530, filed on Sep. 20, 2002.

(51) Int. Cl.
*B67D 7/16* (2006.01)

(52) U.S. Cl.
USPC ..... 222/71; 222/23; 222/333; 222/383.1; 222/328; 222/538; 222/539; 417/42

(58) Field of Classification Search ..... 222/259, 222/526, 538, 539, 23, 30, 36, 59, 71, 333, 222/383.1, 382
See application file for complete search history.

(56) References Cited

U.S. PATENT DOCUMENTS

| | | | | |
|---|---|---|---|---|
| 2,229,844 | A | | 1/1941 | Garancher |
| 4,138,042 | A | * | 2/1979 | Okada ..... 222/529 |
| 4,719,991 | A | | 1/1988 | Diehn et al. |
| 4,883,202 | A | | 11/1989 | Wahl et al. |
| 5,228,594 | A | | 7/1993 | Aslin ..... 222/63 |
| 5,242,271 | A | | 9/1993 | Quarve et al. |
| 5,533,648 | A | | 7/1996 | Read et al. ..... 222/108 |
| 5,601,413 | A | * | 2/1997 | Langley et al. ..... 417/12 |
| 5,635,625 | A | | 6/1997 | Tsunoda et al. |
| 5,704,767 | A | | 1/1998 | Johnson et al. |

(Continued)

FOREIGN PATENT DOCUMENTS

| | | |
|---|---|---|
| DE | 87 05 299 | 8/1988 |
| DE | 8705299 | 8/1998 |
| FR | 2 786 477 | 6/2000 |
| FR | 2786477 | 6/2000 |

*Primary Examiner* — Paul R Durand
*Assistant Examiner* — Melvin Cartagena
(74) *Attorney, Agent, or Firm* — Douglas B. Farrow

(57) ABSTRACT

An integrated design for dispensing lubricants and similar fluids from bulk containers incorporates a dispense valve (8), a meter (1), a hose (7), a DC powered electric pump (2), power cord (18) and adjustable fluid suction tube (5), all packaged in one portable unit The unit is capable of dispensing fluids such as standard SAE grade automotive motor oils, automatic transmission fluid, gear lube, hydraulic oil and engine coolant (antifreeze) The pump motor will shut down at completion of dispense; and emergency shut-off to be provided.

8 Claims, 2 Drawing Sheets

U.S. PATENT DOCUMENTS 5,743,357 A * 4/1998 Few ..... 184/1.5
5,957,329 A 9/1999 Kenney et al.
5,975,162 A 11/1999 Link, Jr. ..... 141/231
6,659,306 B2 12/2003 Boyle et al. ..... 222/1
6,729,364 B2 * 5/2004 Few et al. ..... 141/65

* cited by examiner

SELF CONTAINED LUBRICANT DISPENSER

TECHNICAL FIELD

This application claims the benefit of U.S. Application Ser. No. 60/412,530, filed Sep. 20, 2002.

BACKGROUND ART

While larger vehicle maintenance and service facilities have a number of options for automated metered dispensing of fluids, smaller facilities performing relatively few daily oil changes (e.g. 5) have less choice. In such applications, lubricants may be dispensed by (1) pouring from quart/liter containers; (2) hand pumping from a bulk container; or (3) filling a bucket or other container with the desired quantity of lubricant and then pouring from that container into the vehicle.

DISCLOSURE OF THE INVENTION

It is therefore an object of this invention to provide a portable integrated oil dispensing unit primarily for use in auto repair shops and low volume service stations where low volume, infrequent fluid dispense is desired.

Towards this end, the integrated design incorporates a dispense valve, a meter, a hose, an AC powered (plug it into a normal wall socket) electric pump, power cord and adjustable fluid suction tube, all packaged in one portable unit. The unit is capable of dispensing fluids such as standard SAE grade automotive motor oils, automatic transmission fluid (ATF), gear lube, hydraulic oil and engine coolant (antifreeze) The pump motor will shut down at completion of dispense; and emergency shut-off can be provided These and other objects and advantages of the invention will appear more fully from the following description made in conjunction with the accompanying drawings wherein like reference characters refer to the same or similar parts throughout the several views.

BEST MODE FOR CARRYING OUT THE INVENTION

Figure 1:
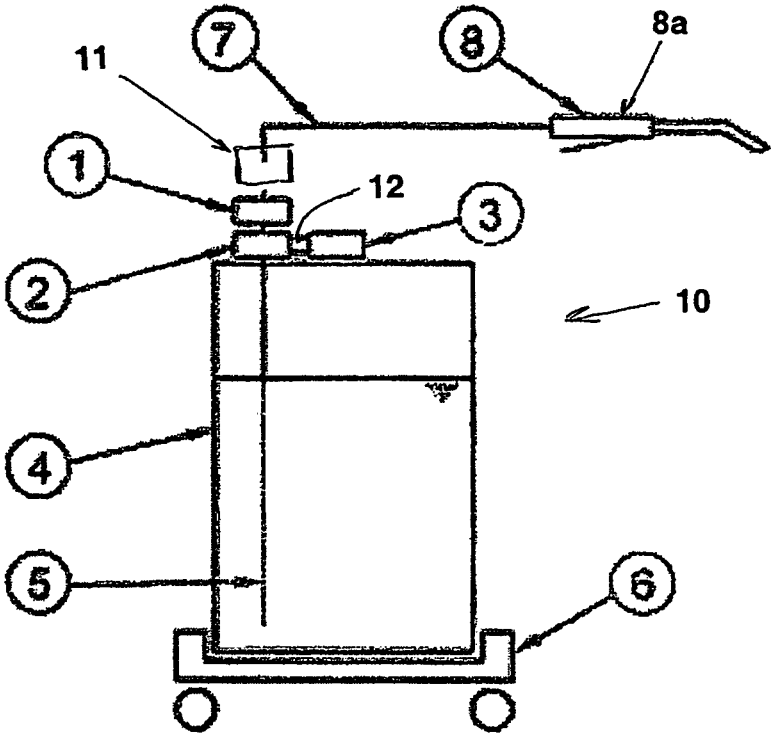
FIG. 1 is a schematic view of the lubricant dispenser of the instant invention.
Figure 2:
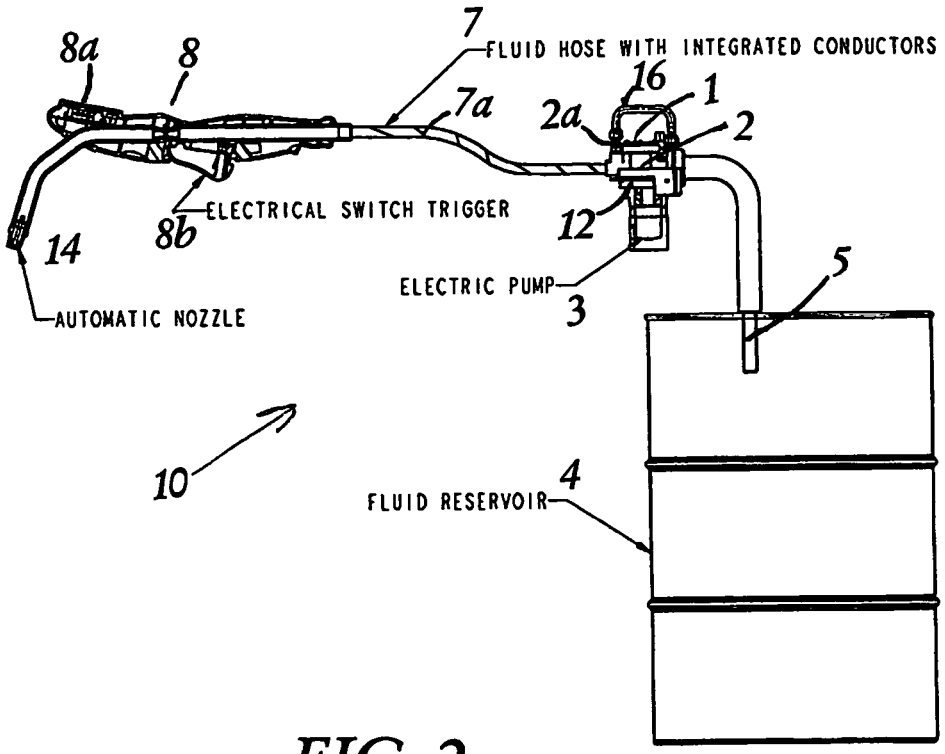
FIG. 2 is a view of the lubricant dispenser of the preferred embodiment of the instant invention.

The instant invention, generally designated 10, is comprised of a flow meter 1 in conjunction with a pump 2. In the preferred embodiment, these two elements are combined wherein pump 2 is of the gerotor type and the flow meter 1 is formed by locating a Hall Effect sensor 2*a* in the gerotor housing so as to count the pulses generated by movement of the gerotor teeth due to fluid flow therethrough.

A DC motor 3 drives pump 2 through a gearbox 12 to reduce the rpm level. In the preferred embodiment, the motor 3 runs at 20,000 RPM and is geared down to around 600 rpm to yield a flow rate of around 1.5 gallons per minute. Dispenser 10 is designed for mounting on a bulk fluid container 4 and has a suction tube 5 depending downwardly into container 4. A portable base 6 may be provided.

Dispensing hose 7 leads to dispense valve 8 which has a display 8*a* thereon to indicate the amount dispensed. Dispense valve 8 is provided with a non-drip nozzle 14 which requires a pressure of about 20 psi in order to open and provide fluid flow. Dispense valve 8 also has a trigger 8*b* which is an electrical switch rather than a mechanical valve and communicates with control 16 either via a wireless link or through one or more wires 7A incorporated into hose 7. A hose reel 11 or hose rack (for winding up hose) is desirably incorporated into the unit 10. Flow meter 1 transmits volume dispense information to display 8*a* either via a wireless link or through one or more wires 7A incorporated into hose 7.

For operation, all the operator need do is insert suction tube 5 into container 4 and place unit 10 on top of container 4. After plugging in the unit, it is ready to dispense. The unit first has to be primed, that is, by opening the dispense valve 8 until fluid flows from valve 8. At that point, flow meter 1 will read the amount dispensed. The flow meter/display combination and associated control electronics are also capable of performing preset dispense, that is, a desired amount (e.g. 5 quarts) is designated by the operator and the unit ceases dispensing when that amount has been dispensed.

It is contemplated that various changes and modifications may be made to the lubricant dispenser without departing from the spirit and scope of the invention as defined by the following claims.

The invention claimed is:

1. A unitary dispenser for dispensing lubricants and the like from and mounting on a bulk container, said dispenser comprising:

a motor;

a pump mounted on said bulk container and having a pump housing, said pump being driven by said motor;

a flow meter located in said housing and incorporated into and part of said pump;

a suction tube depending into said bulk container from said pump;

a dispense valve; and a dispense hose connecting said pump and said dispense valve.

2. The dispenser of claim 1 further comprising a display on said dispense valve for the amount of fluid dispensed, said display being in communication with said flow meter.

3. The dispenser of claim 1 further comprising a hose storage device.

4. The dispenser of claim 3 wherein said hose storage device is a hose reel.

5. The dispenser of claim 1 wherein said dispense valve comprises a valve requiring a predetermined non-negligible non-zero fluid pressure to open.

6. The dispenser of claim 1 wherein said dispense valve communicates with said flow meter through said dispense hose.

7. The dispenser of claim 1 wherein said dispense valve communicates with said flow meter through a wireless link.

8. The dispenser of claim 1 wherein said pump is a gerotor.

* * * * *